United States Patent [19]

Vess

[11] 4,102,370

[45] Jul. 25, 1978

[54] PORTABLE ROUTER ATTACHMENT

[76] Inventor: P. Jackson Vess, 2901 Poplar Dr., Lynwood, Calif. 90262

[21] Appl. No.: 820,397

[22] Filed: Jul. 29, 1977

[51] Int. Cl.[2] ..... B27C 5/10

[52] U.S. Cl. ..... 144/134 D; 90/12 D

[58] Field of Search ..... 90/12 D; 144/134 D, 144/136 C

[56] References Cited

U.S. PATENT DOCUMENTS

| | | | |
|---|---|---|---|
| 3,332,462 | 7/1967 | Williams | 144/136 C |
| 3,466,973 | 9/1969 | Rees | 90/12 D |
| 3,791,260 | 2/1974 | Ambler et al. | 144/134 D X |

*Primary Examiner*—Gil Weidenfeld

*Attorney, Agent, or Firm*—Seiler & Quirk

[57] ABSTRACT

A spring bias spacing attachment for a portable electric router is placed between the router motor and the base of the router. The attachment, which comprises two concentric rings separated by a series of springs, is slidably mounted over the skirt of the router motor housing prior to inserting the motor into the router base. By exerting pressure on the upper portion of the spacing attachment, the router operator may continuously vary the depth of cut of the router as cutting proceeds.

6 Claims, 4 Drawing Figures

PORTABLE ROUTER ATTACHMENT

BACKGROUND OF THE INVENTION

A depth of cut adjustment mechanism is an integral part of virtually every router. Most portable routers consist of two pieces, the first consisting of a base portion having a vertical cylindrical shaft, and the second comprising a motor portion which is adjustably positioned within the shaft. The depth of cut of the blade is adjusted by mechanically adjusting the position of the motor in the base.

Examples of mechanical depth adjustment for a router are found in Moretti et al, U.S. Pat. No. 2,867,251 and Hawley et al, U.S. Pat. No. 3,443,479. Each of these patents disclose routers having vertically threaded housings on the motors which engage threads on the inside of the shaft of the base. Depth adjustment is made simply by rotating the motor relative to the base. These adjustment mechanisms are useful but do not allow a continuous adjustment of the depth of the router blade during cutting. In other words, any time the operator desires to change the depth of cut he must turn the router off, adjust the depth by turning the threads, lock the adjustment in place, and turn the router back on.

It is also known to have a router which has a motor biased relative to a base. Williams, U.S. Pat. No. 3,332,462, shows a spring-mounted attachment for use in template routing. This attachment fixes to the bottom of the router base and consists of a spring-mounted piston having a guide collar concentric with the router bit. In the normal position, the collar surrounds the bit preventing contact of the bit with the template. When the collar is placed in the opening in the template the weight of the router compresses the spring, extending the bit through the collar and into the work piece. The collar remains in the template and protects the template during use of the router.

A router having a spring-biased telescoping base unit is disclosed in Ambler, U.S. Pat. No. 3,791,260. A helical compression spring mounted in the base encircles the motor and retains it in a retracted position for plunge cutting. The depth of cut may be preset while the router is in the retracted position and the router than placed over the work piece. The router motor is then turned on and the motor is then pressed downwardly against the bias of the spring until it engages the preset locking device which locks the motor into operating position. When the cutting operation is finished, the lock is released and the router will return to retracted position. As with all other routers, only a single cutting depth is envisioned for each operation.

In recent years many operators have developed an advanced degree of sophistication in the use of the router which enables the router to be used to create very artistic work pieces. A skilled operator can turn out very attractive free hand signs containing script-type lettering in a matter of just a few minutes. In addition, routers are finding increasing use among hobbists who enjoy designing artistic woodworking pieces. A serious limitation on the use of the router is the necessity for stopping the router, unlocking the depth adjustment mechanism, and resetting it anytime the operator desires to cut at a different depth. No provision has been made for a portable router which will enable the operator to vary the depth of cut while the router is in use.

Accordingly, it is an object of the invention to provide an attachment for a portable router which will enable continuous depth-of-cut adjustment. It is another object of the invention to provide a simple, continuous depth of cut adjustment mechanism which can be quickly and easily placed on a conventional router. It is yet a further object of the invention to provide an inexpensive, easily manufactured device which can be slipped over a conventional router motor housing without the use of special tools.

SUMMARY OF THE INVENTION

An attachment for a portable electric router for allowing continuously variable depth of cut during use, the router having a hollow base and a separate motor housing which slidably fits within the base, the attachment comprising a first support member secured to and spaced from said first support member and biasing means for maintaining said support members spaced from each other.

BRIEF DESCRIPTION OF THE DRAWINGS

The invention is best understood with reference to the drawings in which.

DETAILED DESCRIPTION OF THE INVENTION

Figure 1:
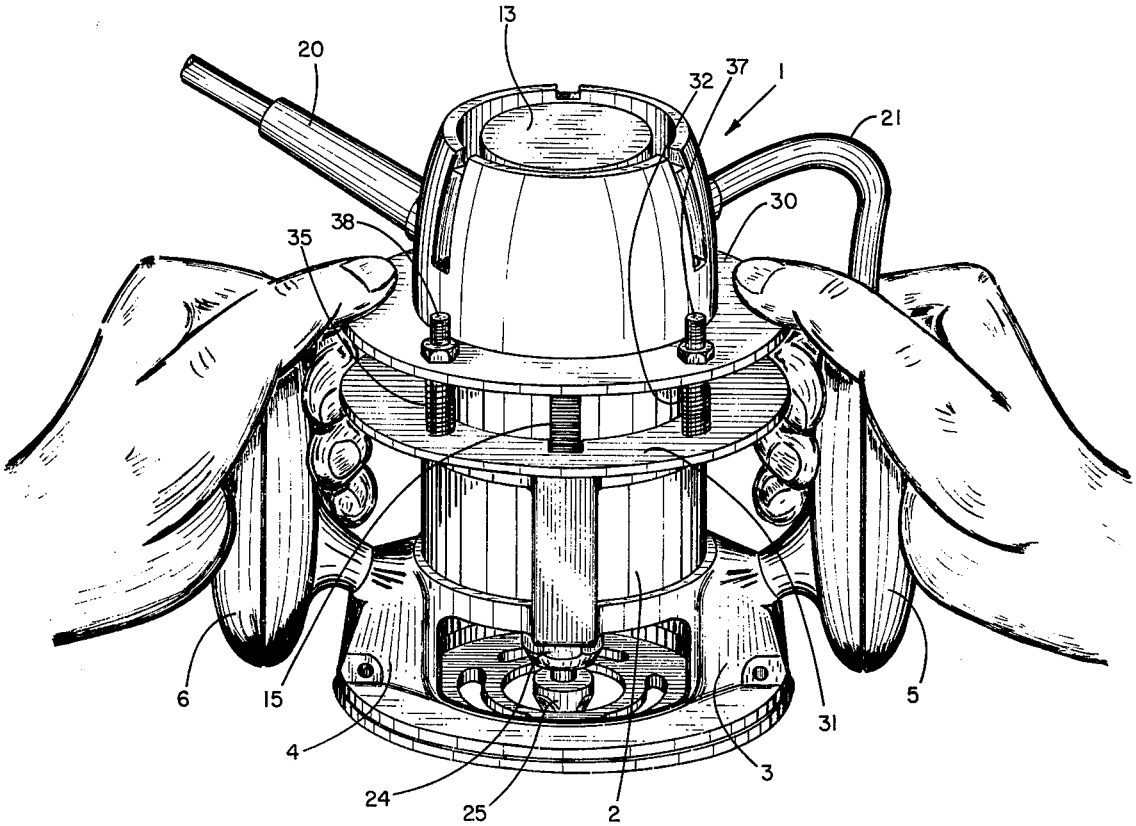
FIG. 1 is a perspective view of the depth-of-cut attachment in place on a router showing its method of use.
Figure 2:
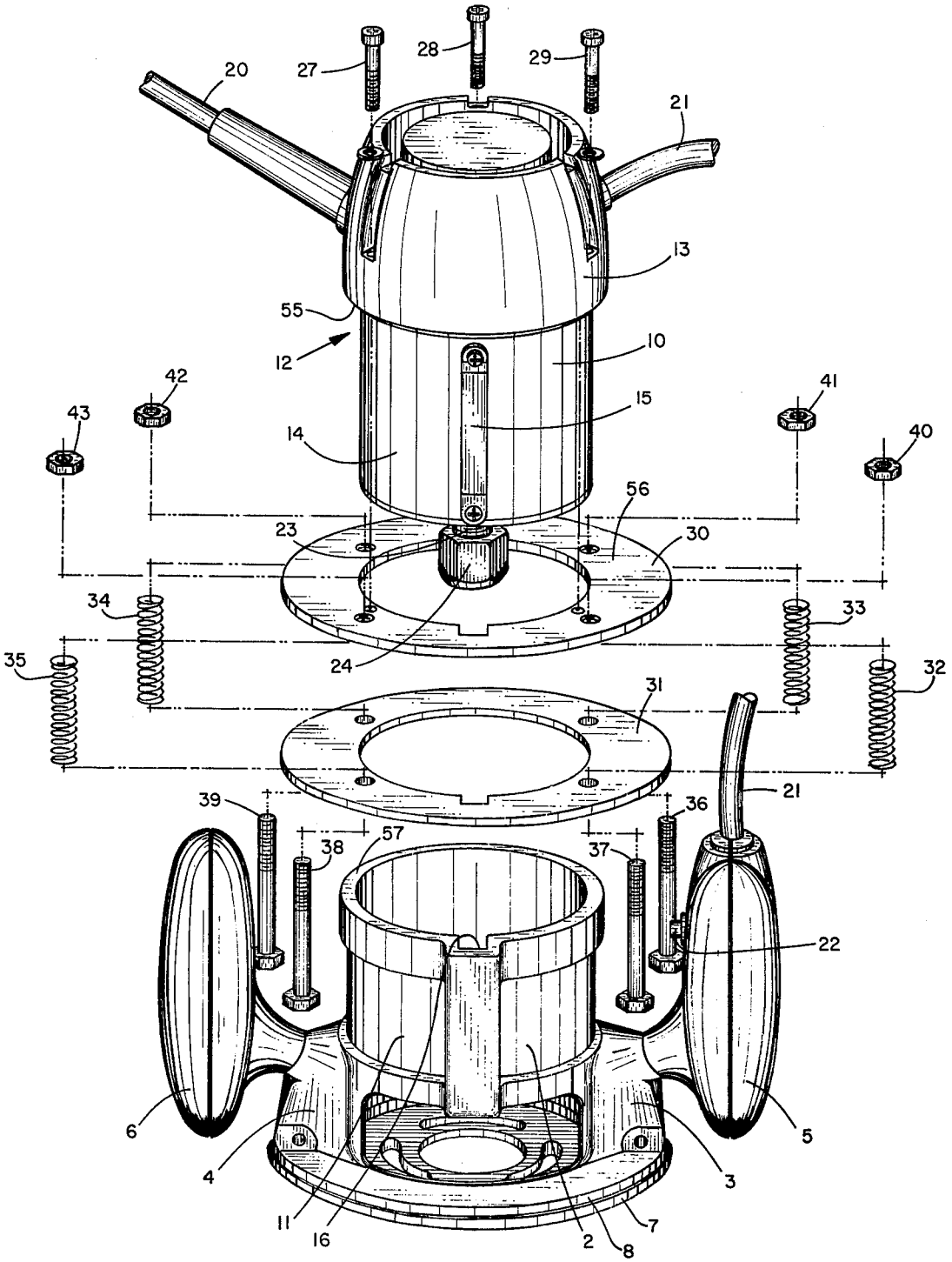
FIG. 2 is an exploded perspective view of the attachment showing its position on the router.

Referring to the drawings, router 1 is a conventional type of router of the type described in Rees, U.S. Pat. No. 3,466,973. The router consists of two basic portions, namely, a stationary base 2 and a motor portion 10. The base has a flat disc portion 7 which may be plastic such a Teflon and which is adapted to contact the work piece. The disc is secured to a steel flange 8. Two diametrically opposed legs 3 and 4 support handles 5 and 6 which are used to hold the router.

A vertical, hollow, cylindrical shaft 11 is centrally situated in the base. The motor portion 10 of the router has an external housing 12 which comprises an insulated end cap 13 and a depending cylindrical skirt 14, which is adapted to telescope within the base 2 for vertical sliding motion relative thereto. When the continuous adjustment mechanism of the invention is not in use the router shown in the drawings is equipped with a rack and pinion depth-of-cut adjustment mechanism of the type described in U.S. Pat. No. 3,466,973. This mechanism comprises a rack member 15, vertically mounted on the motor housing which fits in groove 16 in the base. The pinion assembly which engages the rack for vertical adjustment has been removed from the router shown in the drawings and is not used with the adapter of the invention, thus allowing the motor to slide freely vertically within the shaft 11 of the base.

Electric power is supplied to the router motor through cable 20. Switch cable 21 allows actuation of the motor with hand operated on-off switch 22 located on the inside of grip 5. The electric motor (not shown) contained within housing 14 has an output shaft directly connected to the chuck 23. Router bit 25 is secured in the chuck by nut 24. Cap 13 is secured to the end of the motor by screws 27, 28 and 29, which extend through apertures in the cap and engage threaded female portions in the motor assembly (not shown). These screws extend through the bottom of the cap.

Figure 3:
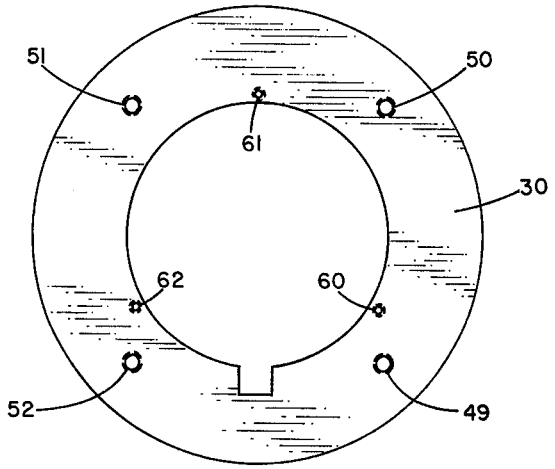
FIG. 3 is a top view of the upper spacing ring of the invention.
Figure 4:
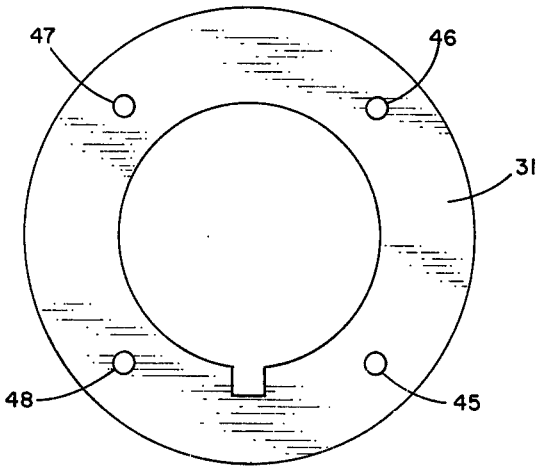
FIG. 4 is a top view of the lower spacing ring of the invention.

The apparatus of the invention consists of two support rings 30 and 31 which are adapted to loosely fit over the skirt portion 14 of the motor housing. The support rings are maintained in spaced relation by helical compression springs 32, 33, 34 and 35. The rings are fastened together by bolts 36, 37, 38 and 39 and nuts 40, 41, 42 and 43. The bolts extend through non-threaded holes 45, 46, 47 and 48 in the lower ring and through concentric holes 49, 50, 51 and 52 in the upper ring (see FIGS. 3 and 4). The fit of the bolts through the holes in the two rings is relatively loose to insure that the operator can freely move the two rings relative to each other along the bolts.

Installation and operation of the apparatus of the invention is quite simple. First, the support rings are assembled by inserting the bolts through the holes in the bottom plate, sliding the springs on the bolts and placing the upper ring above the springs on the bolts. Next, the nuts are threaded on the bolts to an extent that would very slightly compress the springs with no load. The spacer assembly is then put into place over the router motor housing and the motor housing is put into the shaft of the base. The ledge 55, formed by the extension of the motor cap 13 over the housing shaft 14, rests upon the upper surface 56 of the upper support ring, and the lower surface of the lower support ring rests on the upper surface 57 of the shaft of the base. The weight of the router motor will slightly compress the springs, moving the support rings closer to each other. Accordingly, it is desirable to adjust the router bit in the chuck to reach a level slightly above the work piece when the adapter is in place and when no additional pressure is placed on the motor.

Operation of the router with the adapter in place is also quite simple. The operator grips the handles as shown in FIG. 1 and places his thumbs on the upper surface 56 of the top support ring. By pressing down with his thumbs and lowering the upper support ring, the weight of the router drives the router bit into the work piece. By varying the pressures applied on the top ring, the operator can adjust the depth of cut to a level from a very fine line to a cut of full depth continuously as he moves along the work piece.

If a relatively large router blade is used, the weight of the motor may not be sufficient to drive the router bit to full depth into the piece. Accordingly, it may be desirable in some cases to attach the upper ring to the router motor. This is most easily accomplished by substituting longer screws of the same diameter for motor cap screws 27, 28 and 29. These screws extend below the ledge 55 at the bottom of the cap and may engage threaded holes 60, 61 and 62, which are located in the inner periphery of the upper support ring. These screws then securely fasten the upper ring to the router motor such that when pressure is put on the upper plate, the router motor is driven downward and the bit is firmly pressed into the work piece. With practice, an operator can become highly skilled at making designs of great complexity since the depth of cut of the router varies the width of the line as well as the depth of the line. If a cut of constant depth is required, the conventional locking mechanisms for depth of cut adjustment may be used. Accordingly, the adapter of the invention adds another dimension to the utility of a router.

The support rings may be made from any rigid structural material. Sheet metal such as steel or aluminum, as well as rigid plastic may be used. The support rings have a dimension of approximately $5\frac{1}{2}$–6 inches diameter and $\frac{3}{8}$ inch thickness. The diameter of the aperture in the center of the ring is approximately $3\frac{1}{2}$ inches, but is at least 1/16 inch greater in diameter than the diameter of the skirt of the motor housing. Conventional bolts, nuts and springs may be used; the number of springs and the spring constant are chosen such that the weight of the router motor along only slightly compresses the springs, but excessive pressure by the operator of the router is not necessary to overcome the force of the springs in order to drive the router bit into the work piece.

Many modifications of the invention are possible within the scope and spirit of the invention. For example, the support rings need not be circular and could be of any shape to accomplish the function of biasing the motor from the base. In addition, support members with thumbrests could be built into the router motor member which could interface with built-in spring members built into the base. Accordingly, while the device of the invention is useful as an attachment to existing routers, it is also possible to manufacture routers having a built-in biasing mechanism with thumbrests or similar pressure-receiving members for biasing the router motor relative to the base as described in the above specification. Accordingly, the invention should be considered limited only by the following claims.

I claim:

1. Apparatus for providing continuous depth-of-cut adjustment for a portable router having a base portion and a motor portion which slidably mounts vertically within said base portion, the apparatus comprising first rigid spacing means for supporting said motor portion adapted to abut the motor portion, second rigid spacing means adapted to abut the base portion, and biasing means for maintaining the first and second spacing means in biased spaced relationship.

2. The apparatus of claim 1 wherein the motor portion of the router has a cylindrical housing, and the first rigid spacing means comprises a flat, rigid ring member which fits slidably over the housing.

3. The apparatus of claim 2 wherein the second rigid spacing means comprises a flat, rigid ring member which fits slidably over the housing.

4. The apparatus of claim 1 wherein the biasing means comprises a plurality of helical coil springs.

5. The apparatus of claim 1 also comprising fastening means for securing the biasing means to the first and second spacing means.

6. The apparatus of claim 1 also comprising fastening means for securing the first rigid spacing means to the motor portion of the router.

* * * * *